US008104636B2

(12) United States Patent
Crain et al.

(10) Patent No.: US 8,104,636 B2
(45) Date of Patent: Jan. 31, 2012

(54) INSULATING KNITTED BEVERAGE JACKET COZY

(76) Inventors: Zachery Michael Crain, Wilmington, NC (US); Zachary Michael DeBartolo, Mebane, NC (US)

( * ) Notice: Subject to any disclaimer, the term of this patent is extended or adjusted under 35 U.S.C. 154(b) by 328 days.

(21) Appl. No.: 12/554,857

(22) Filed: Sep. 4, 2009

(65) Prior Publication Data

US 2011/0056969 A1 Mar. 10, 2011

(51) Int. Cl.
*B65D 25/00* (2006.01)

(52) U.S. Cl. ..... 220/739; 220/903; 206/524.1; 215/395; 215/386

(58) Field of Classification Search ..... 220/737, 220/738, 739, 903, 62.11, 62.12; 206/524.1, 206/524.6, 524.3; 215/395, 386, 12.1; 428/34.1
See application file for complete search history.

(56) References Cited

U.S. PATENT DOCUMENTS

| | | | | |
|---|---|---|---|---|
| 4,293,015 | A * | 10/1981 | McGough | 220/739 |
| 4,514,995 | A * | 5/1985 | Curtis et al. | 66/170 |
| 4,671,424 | A * | 6/1987 | Byrns | 220/592.16 |
| 4,871,597 | A * | 10/1989 | Hobson | 428/36.1 |
| 5,415,305 | A * | 5/1995 | Drake-Tipton et al. | 215/392 |
| 5,946,936 | A | 9/1999 | Bengtson | |
| 6,655,543 | B2 * | 12/2003 | Beuke | 220/739 |

OTHER PUBLICATIONS

Like a Phantom Band, Knitting Journal, The Bottle Cozy, Nov. 5, 2007.
King'S Cozy, Jul. 19, 2008.
The Kelly-Green Rogue, Water Bottle Cozy, Aug. 2, 2007.
White Trash Knitters, Jul. 19, 2008.

* cited by examiner

*Primary Examiner* — Jacob K Ackun
*Assistant Examiner* — Kareen Rush
(74) *Attorney, Agent, or Firm* — Jim Passe; Passe Intellectual Property, LLC

(57) ABSTRACT

The present invention relates to an insulating knit bottle cozy jacket which provides a tight fit, insulation, a coaster bottom as well as the ability to have decorative cover.

11 Claims, 7 Drawing Sheets

INSULATING KNITTED BEVERAGE JACKET COZY

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a novel knitted bottle insulating type cozy. In particular the present invention relates to a particular novel construction of a beverage cozy or jacket design for a bottle that successfully adheres to a multiplicity of container's shapes without stretching, wrinkling or other problems associated with prior knitted cozies.

2. Description of Related Art

The use of a jacket cozy over a beverage bottle, can or the like for the purposes of keeping the beverage container cold or hot, for preventing condensation or from preventing heat or cold transfer to the hand or container while using the container are fairly well known. These devices also protect furniture and the like.

There are some concerned primarily with insulation, such as ones made of Styrofoam, neoprene or the like while fabric or knitted devices are more about the feel and look of the cozy. A problem with knitted cozies' designs, however, is that they tend to bunch up or fall off the bottle or can or are simple designs which do not work on a bottle with a neck such as a bear bottle.

In U.S. Pat. No. 4,293,015 to McGough issued Oct. 6, 1981 there is claimed a cozy for a 12 inch beverage can which has a cylindrical body and filled with goose down. While this device is useful for a cylindrical can it is of no use on a tapered bottle. Beer bottles, soda bottles, plastic water bottles, sports drink like bottles, baby bottles and the like have a body portion and a tapered neck portion. Typical knit type cozies have a single material with a tapered design, however, these do not stay in place easily and must be made to the exact measurements of a specific bottle while bottle designs vary greatly.

BRIEF SUMMARY OF THE INVENTION

The present invention relates to the discovery that if a knitted bottle cozy has different materials on the inside and outside at the top welt and bottom welt areas, in addition, as well as different materials in the body versus the neck area a bottle cozy is produced which improves in fit and coverage usage of the product over previously discovered knitted bottle cozies. As mentioned in the past, knitted cozy products were more about the look and feel while the novel present invention cozy products improve the insulating properties of the cozy making them as useful as other non-knit compositions such as neoprene for their insulating properties.

In one embodiment the present invention is a bottle knitted jacket comprising:

a) a top welt area inside area comprising:
   i. a polyamide fiber; and
   ii. an elastomeric covered polyamide fiber having a denier from about 160 to about 320;
   wherein the welt inside area can extend to the inside neck of the jacket;

b) a top welt area outside area comprising:
   i. a non-elastomeric fiber;
   ii. an elastomer covered polyamide fiber having a denier from about 5 to about 60; and
   iii. and an elastomeric covered polyamide fiber having a denier from about 160 to about 320;

c) a bottom welt area inside area comprising;
   i. an elastomer covered polyamide fiber having a denier from about 5 to about 60; and
   ii. an elastomeric covered polyamide fiber having a denier from about 160 to about 320;
   wherein the closing inside area can extend to the inside body of the jacket;

d) a bottom welt area outside area comprising:
   i. a non-elastomeric fiber;
   ii. an elastomer covered polyamide fiber having a denier from about 60 to about 220; and
   iii. an elastomeric covered polyamide fiber having a denier from about 160 to about 320;

e) a neck area comprising
   i. a non-elastomeric fiber;
   ii. an elastomer covered polyamide fiber having a denier from about 5 to about 60; and
   iii. an elastomeric covered polyamide fiber having a denier from about 160 to about 320; and f) a body area comprising;
   i. a non-elastomeric fiber;
   ii. elastomer covered polyamide fiber having a denier from about 60 to about 220; and
   iii. an elastomeric covered polyamide fiber having a denier from about 160 to about 320.

DETAILED DESCRIPTION OF THE INVENTION

Figure 1:
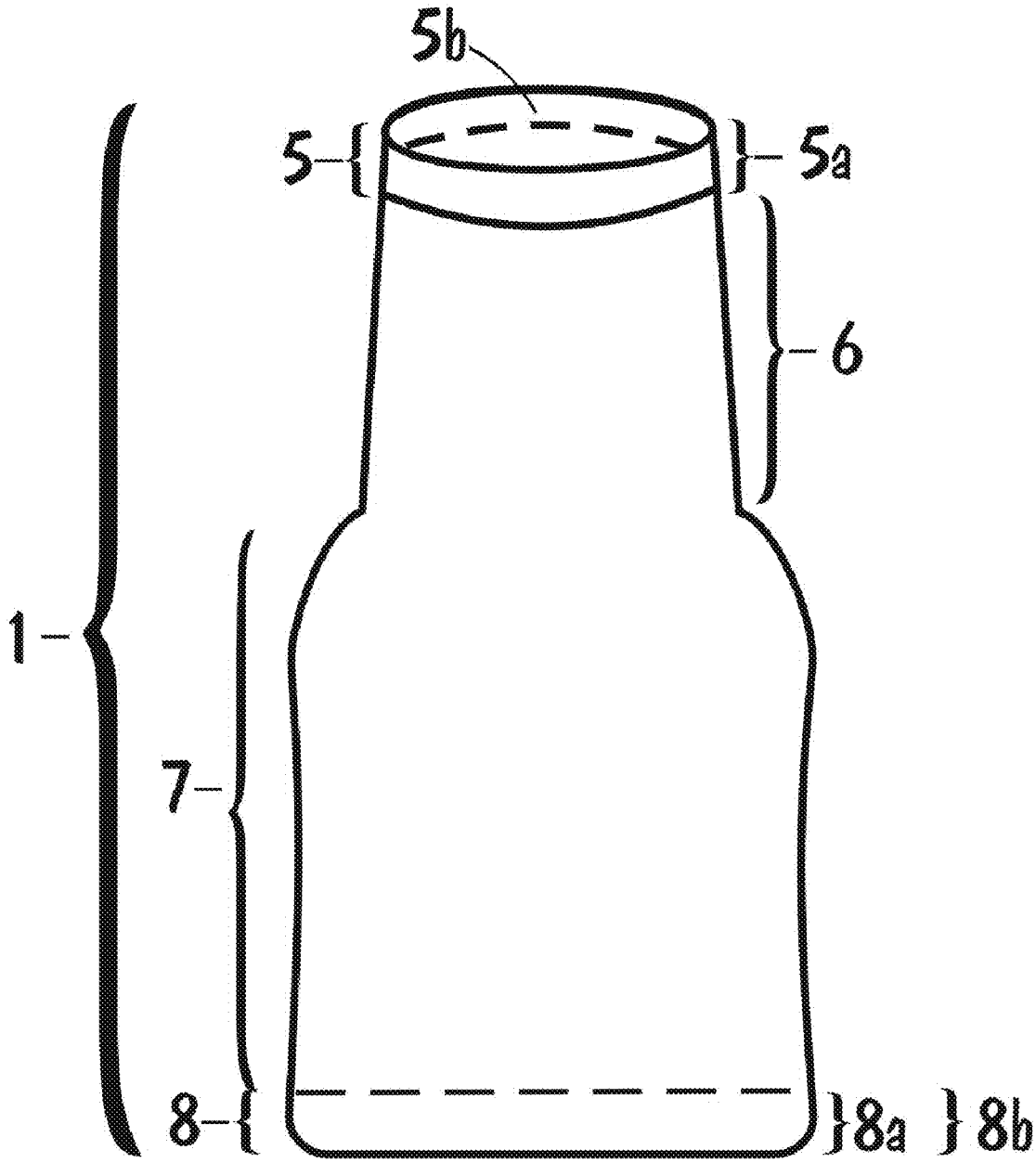
FIG. 1 is a perspective view of the cozy of the present invention.

While this invention is susceptible to embodiment in many different forms, there is shown in the drawings and will herein be described in detailed specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "bottle" refers to the type of glass bottle, plastic bottle or metal can used for drinks primarily in the beer and soda area but also for those types of sports drinks and the like as well as a baby bottle. While there are many versions in terms of style and design, bottles essentially consist of a cylindrical body area and a neck area which have a tapered or narrower top or neck area in many cases. In the United States, the most common variety of this shape is the longneck bottle, though versions like the stubby, Beugel and the like also have the same basic design of body and smaller neck portion. There are also varieties which have a neck portion that does not taper at all, for example soda/beer cans and Nalgene containers. The contents of the bottles vary wildly typically from 8 oz to 40 oz though most fall in the 12 and 16 oz size in the United States along with half liter sizes and the like.

As used herein a "knitted jacket" refers to a cozy type covering for a bottle that is manufactured from fibers by a knitted method. The knitting process taxes fibers or blends of fibers and creates rows, also known as courses, of a particular height until an article is completely knitted. The particular knitted jacket of the present invention has 4 separate parts each of which is knitted in a different manner with different fibers to achieve the surprising results of the present invention knitted jacket.

A number of fibers are used in the fabrication of the present invention tapered bottle jacket. Elastomer fibers include those fibers having a stretch ability of up to about 500% and subsequently recoil when tension is released on the fibers. In one embodiment, the elastomer fiber is spandex, a polyurethane elastomer. While several generic brands of spandex are available, the most common trade name for spandex is Lycra brand of spandex. These elastomeric fibers come in a wide range of deniers from about 5 to over 300. In some instances, the spandex can be spandex with a covering of a nylon fiber or other polymeric fiber. This is called elastic. Frequently, the covered fiber is a died colored fiber. The denier of such a fiber would be in one embodiment from about 160 to about 320 denier with an embodiment being about 260. Polyamide fibers are any of the various synthetic fibers having a protein like structure formed between an amino group of one molecule and a carboxylic acid group of another. Examples include polyester and nylon fibers (such as nylon 6, and nylon 10). Non-elastomeric fibers include fibers with essentially no stretch such as wool, cotton, hemp, alpaca, acrylic-cotton blends, acrylic-wool blends, acrylic and the like. They tend to be dimensionally stable. Acrylic fibers are an artificial fiber made from a group of vinyl compounds that consist mostly of acrylonitrile. Acrylic fibers are thermoplastic, have low moisture regain, are low in density and the like.

The present invention knitted tapered bottle jacket comprises 4 parts; the top welt, neck, body and bottom welt areas. The general shape of the jacket is roughly the same as the bottle, that is, a cylindrical area and a neck area. It includes an opening at the bottom in the bottom welt area at and the top in the top welt area as well. In a knitted article each layer of loops is called a course. A typical bottle jacket would be around 100 courses to 200 courses for a standard longneck bottle as an example, although depending on the actual height and type and shape of the bottle to be covered and the height of each course this number would obviously be larger or smaller. The general relationship of the four areas will remain, however, no matter what the final size of the bottle. In general, the bottle knitted jacket will be smaller that the outer diameter of the bottle and will stretch due to the presents of the elastomer to fit over the bottle itself in use. The jacket is elastomeric though, so typically from about 10% to about 75% smaller in relaxed dimensions than the bottle it is to cover.

The top welt area is the uppermost area on the bottle jacket. It is the area just above the neck area and has an opening to accommodate the bottle neck. This shape may change depending on whether the neck is tapered or not. This is a reinforced area and comprises an outer fiber layer knit with inner fiber layer that is different or the same as the outer fiber mix. In other words the top welt area will have two layers of kitted fabric. This can be accomplished by knitting the entire area as a single layer and folding over the inner layer to the inside and sewing or knitting it in place at the top of the jacket.

The top welt inside area will be composed of a mix of 2 different kinds of fibers which would comprise about 1% to about 15% of the entire jacket. A polyamide fiber would comprise from about 10% to about 40% of the inner layer. Next, an elastomeric covered coated polyamide fiber having a denier from about 160 to about 320 would comprise from about 60% to about 90% of the inner layer. One embodiment would be a denier of about 260. The inner layer would roughly match the outer layer in length but several courses short or long in comparison is still within the contemplation of the present invention. In one embodiment the inner and outer welt area match in number of courses.

A top welt area outside area mated to the top welt area inside area although the inside area can be more or less courses as desired like the welt area and folded over to make the layer. The top welt area outside area comprises a mix of 3 different kinds of fibers which would comprise from about 1% to about 15% of the entire jacket. An elastomeric covered polyamide fiber having a denier from about 5 to about 60 would comprise from about 5% to about 25% of the outer layer. In other embodiments the range is 15 to 30 or 10 to 25. One embodiment of the fiber is a denier of about 20. Next an non-elastomeric fiber would comprise from about 50% to about 90% of the outer layer. One embodiment would be a high bulk acrylic fiber. Lastly, an elastomeric coated polyamide fiber having a denier from about 160 to about 320 would comprise from about 5% to about 25% of the outer layer. One embodiment would be a denier of about 260.

The bottom welt area at the bottom of the jacket would also have an opening. It is the last area. It is just below the body area. This opening could be used primarily to pull the jacket over the neck. Since there are openings at the top or bottom it would be possible to put the jacket over a bottle from either direction but normally it would be done by placing the bottom welt area opening over the neck of the bottle and pulling the jacket down into place. This is a reinforced area and comprises an outer fiber layer knit with inner fiber layer that is different or the same as the outer fiber mix. In other words the bottom welt area will have two layers of knitted fabric. This can be accomplished by knitting the entire area as a single layer and folding over the inner layer to the inside and sewing or knitting it in place at the top of the jacket.

The bottom welt area inside area comprises of a mix of 2 different kinds of fibers which would comprise from about 1% to about 30% of the entire jacket. An elastomeric covered polyamide fiber having a denier from about 5 to about 60 would comprise from about 10% to about 40% of the inner layer. In other embodiments 15 to 30 or 10 to 25. One embodiment of the fiber is a denier of about 20. Next, an elastomeric covered polyamide fiber having a denier from about 160 to about 320 would comprise from about 60% to about 90% of the inner layer. One embodiment would be a denier of about 260. The inner layer would roughly match the outer layer in length but several courses short or long in comparison is still within the contemplation of the present invention. In one embodiment the inner and outer welt area differ in number of courses.

A bottom welt area outside area is mated to the bottom welt inside area (although the inside area can be more or less courses as desired like the welt area and folded over to make the layer). The bottom welt outside area comprises a mix of 3 different kinds of fibers which would comprise from about 1% to about 15% of the entire jacket. An elastomeric covered polyamide fiber having a denier from about 60 to about 220 would comprise from about 5% to about 25% of the outer layer. One embodiment of the fiber is a denier of about 120. Next a non-elastomeric fiber would comprise from about 50% to about 90% of the outer layer. One embodiment would be a high bulk acrylic. Lastly, an elastomeric covered polyamide fiber having a denier from about 160 to about 320 would comprise from about 5% to about 25% of the outer layer. One embodiment would be a denier of about 260.

Next, the neck area comprises a mix of 3 different kinds of fibers which would comprise from about 10% to about 100% of the entire jacket. The neck area would comprise an elastomeric covered polyamide fiber having a denier from about 5 to about 60 which would comprise from about 5% to about 25% of the neck area. In other embodiments the range is 15 to 30, or 10 to 25. One embodiment of the fiber is a denier of about 20. Next a non-elastomeric fiber would comprise from about 50% to about 90% of the neck area. One embodiment would be a high bulk acrylic. Lastly, an elastomeric coated polyamide fiber having a denier from about 160 to about 320 would comprise from about 5% to about 25% of the neck area. One embodiment would be a denier of about 260.

Lastly, the body area comprises a mix of 3 different kinds of fibers which would comprise from about 35% to about 100% of the entire jacket. The body area would comprises, an elastomeric covered polyamide fiber having a denier from about 60 to about 220 would comprise from about 5% to about 25% of the body area. One embodiment of the fiber is a denier of about 120. Next a non-elastomeric fiber would comprise from about 50% to about 90% of the body area. One embodiment would be a high bulk acrylic. Lastly, an elastomeric coated polyamide fiber having a denier from about 160 to about 320 would comprise from about 5% to about 25% of the body area. One embodiment would be a denier of about 260.

The article of the present invention can be made by hand or be made by machine. By making the article with both lengthwise courses and needle widths the article can be knit by means known in the art. The relative heights of the 4 parts can be adjusted by one skilled in the art based on the particular bottle size one wants to cover but the examples drawings which follow give the relative idea of each portion of the jacket of the present invention.

Now referring to the drawings, FIG. 1 is a perspective of a bottle knit jacket cozy 1 of the present invention. The jacket cozy 1 consists of the welt area 5 which comprises the outer layer 5*a* and inner layer 5*b*. In this embodiment the double layers match, however, as described above, the inner top welt area, layer 5*b* could be shorter or longer than the outer top welt area layer 5*a*. The inside top welt area 8*b* in this embodiment is the same size than the outer layer 8*a* although each of the layers could comprise the same or a different number of courses depending on the thickness of the fibers chosen for each layer.

The neck area 6 is the area that matches the bottle neck area, tapered in this embodiment followed by the body area 7. The bottom welt area 8 consists of two layers the outer layer 8*a* and the inner layer 8*b* shown in dotted line perspective since it is hidden inside this embodiment. In this embodiment the double layers match, however, as described above, the inner bottom welt area, layer 5*b* could be shorter or longer than the outer bottom welt area, layer 5*a*. The inside bottom welt area 8*b* in this embodiment is the same size than the outer layer 8*a* although each of the layers could comprise the same or a different number of courses depending on the thickness of the fibers chosen for each layer. The article 1 is knit by any convenient manner. An example follows for the manufacture of one embodiment of the bottle jacket depicted.

Figure 2:
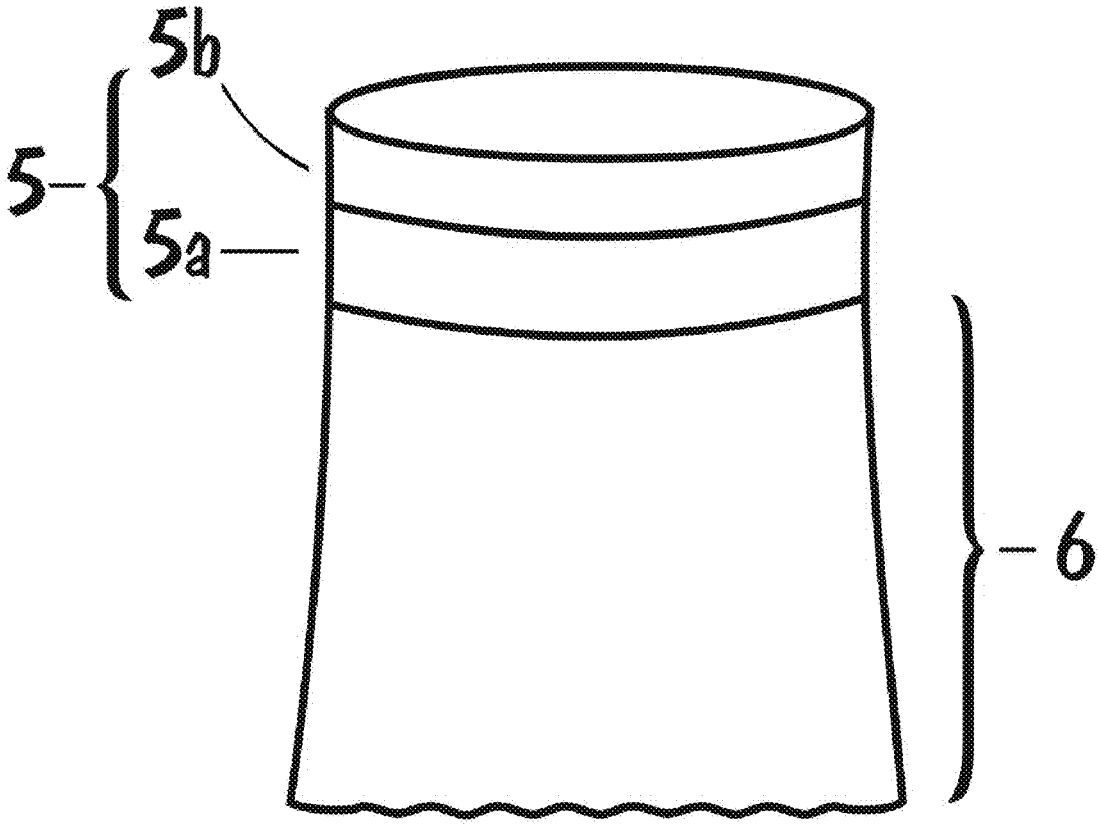
FIG. 2 is a perspective view how the inside area layer can be formed by folding over for the top welt and bottom welt areas.

FIG. 2 depicts the neck area 6 and top welt area, layers 5*a* and 5*b*. In this view the top welt area, layers 5*a* and 5*b* are shown linearly and not back to back. In order to form the layers of the top welt area, the layer 5*b* is merely folded over inside and sewn in place to form the two layers of the top welt area. Similar fabrication is used to create the bottom welt area.

Figure 3:
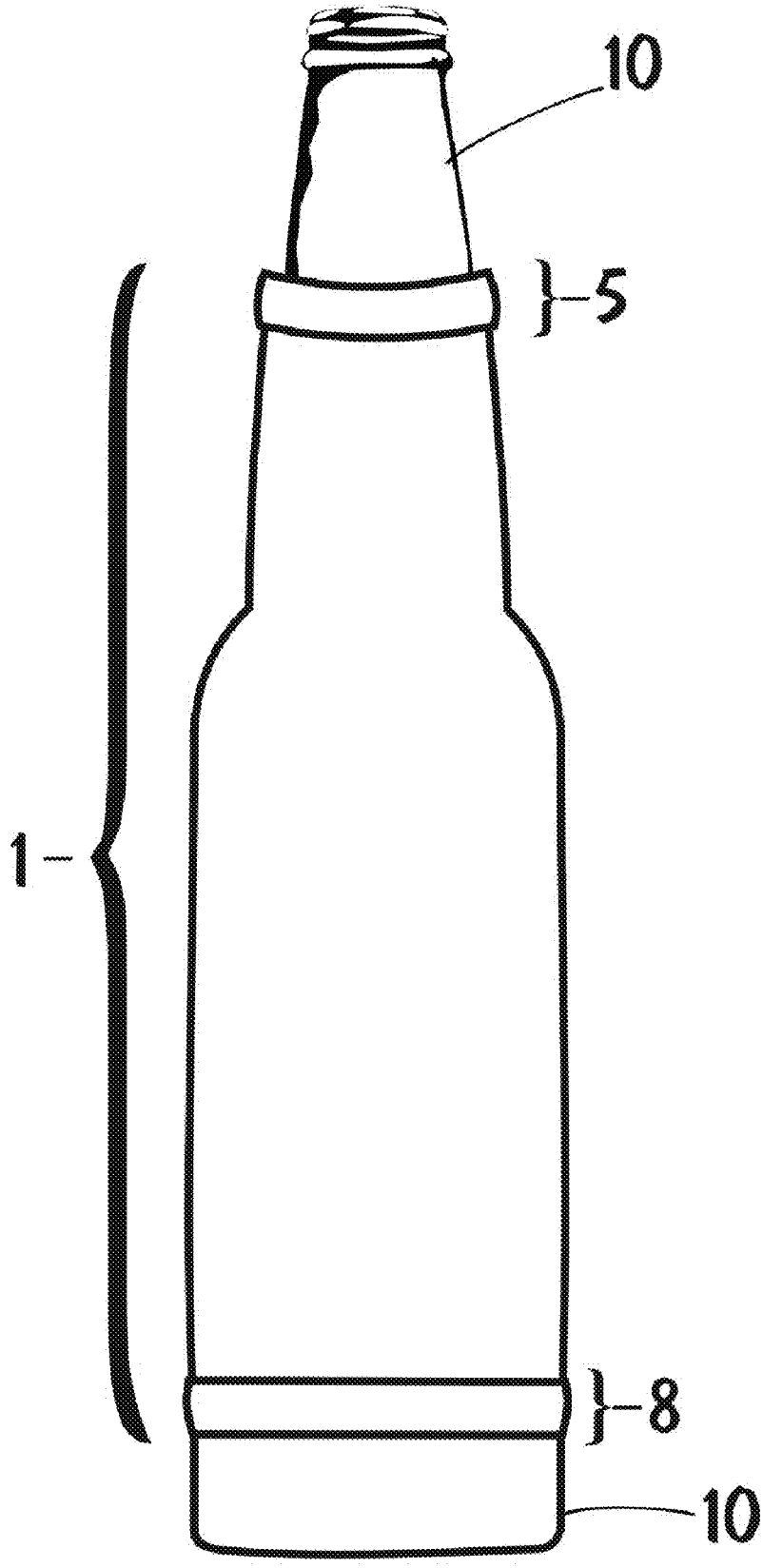
FIG. 3 is a perspective view of the jacket of the invention over a longneck bottle.

FIG. 3 depicts the article of the invention 1 in use over a beer bottle 10. As can be seen in this embodiment the jacket 1 is stretched over the beer bottle and held in place by the stretch of the fabric without wrinkles or other use problems. The beer bottle sticks out the top welt area 5 opening and bottom welt area 8 opening by a small amount allowing the bottle to sit on a table or the like using an uncovered bottle surface and exposing the bottle to for drinking purposes. However, the knitted jacket can be slid down over the bottom of the bottle to be used as a coaster like product.

Figure 4:
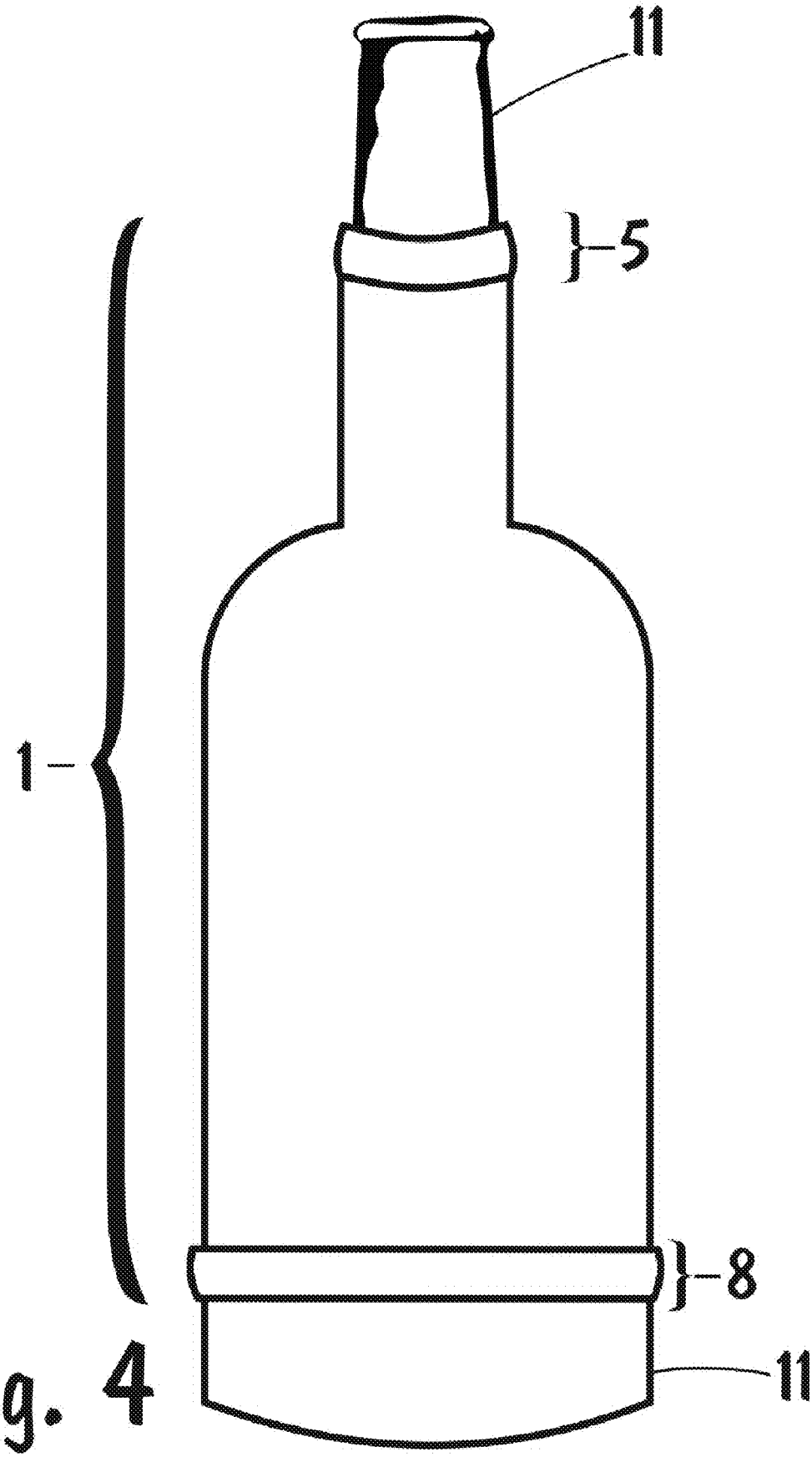
FIG. 4 is a perspective view of the jacket of the invention over a wine like bottle.

FIG. 4 depicts the article of the invention 1 in use over a wine like bottle 11. As can be seen in this embodiment the jacket 1 is stretched over the beer bottle and held in place by the stretch of the fabric without wrinkles or other use problems. The wine bottle sticks out the top welt area 5 opening and bottom welt area 8 opening by a small amount allowing the bottle to sit on a table or the like using an uncovered bottle surface and exposing the bottle to for drinking purposes. However, the knitted jacket can be slid down over the bottom of the bottle to be used as a coaster like product.

Figure 5:
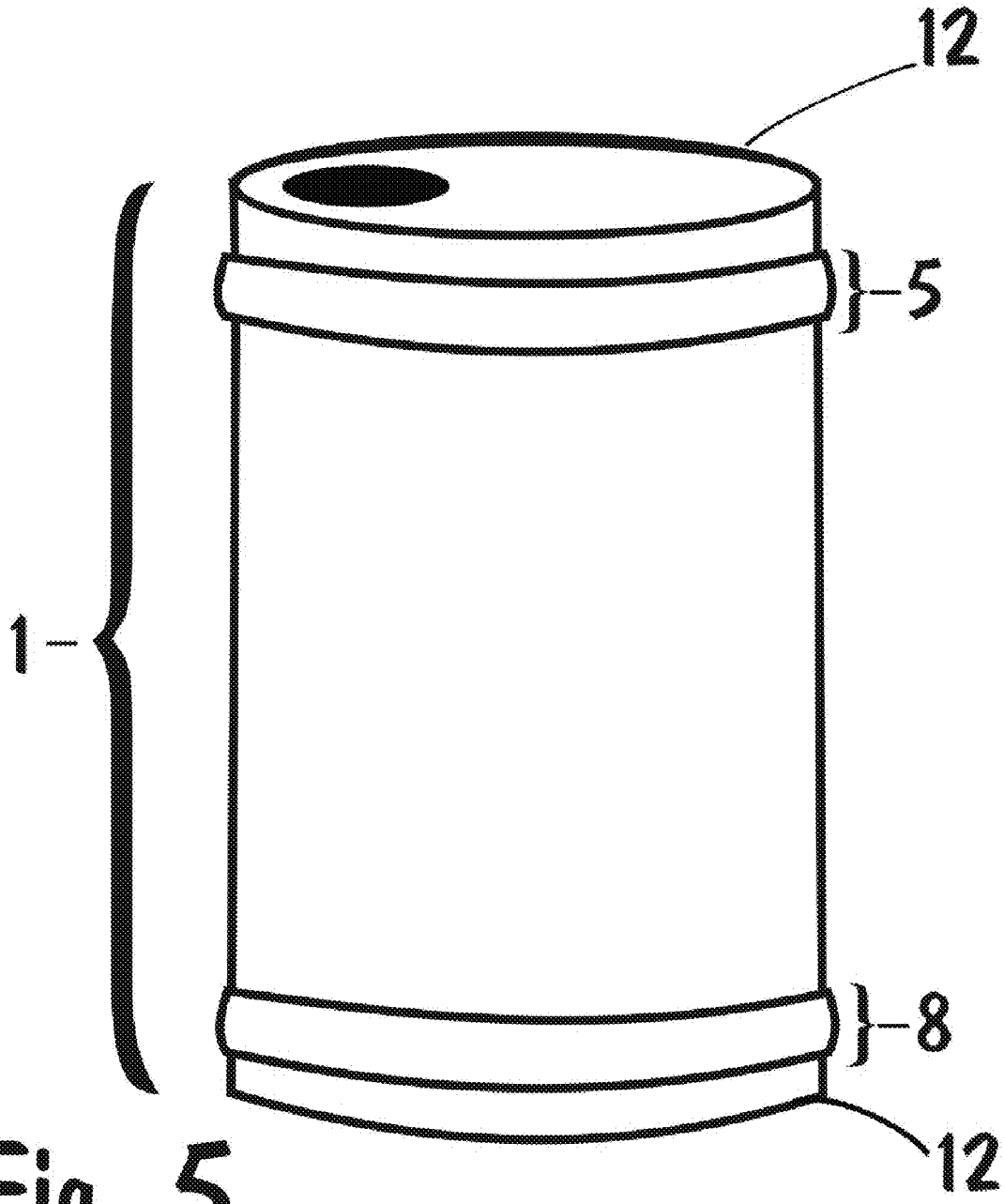
FIG. 5 is a perspective view of the jacket of the invention over a 12 oz like can.

FIG. 5 depicts the article of the invention 1 in use over a 12 oz can like bottle 12. As can be seen in this embodiment the jacket 1 is stretched over the can and held in place by the stretch of the fabric without wrinkles or other use problems. The can sticks out the top welt area 5 opening and bottom welt area 8 opening by a small amount allowing the can to sit on a table or the like using an uncovered bottle surface and exposing the can to for drinking purposes. However, the knitted jacket can be slid down over the bottom of the bottle to be used as a coaster like product.

Figure 6:
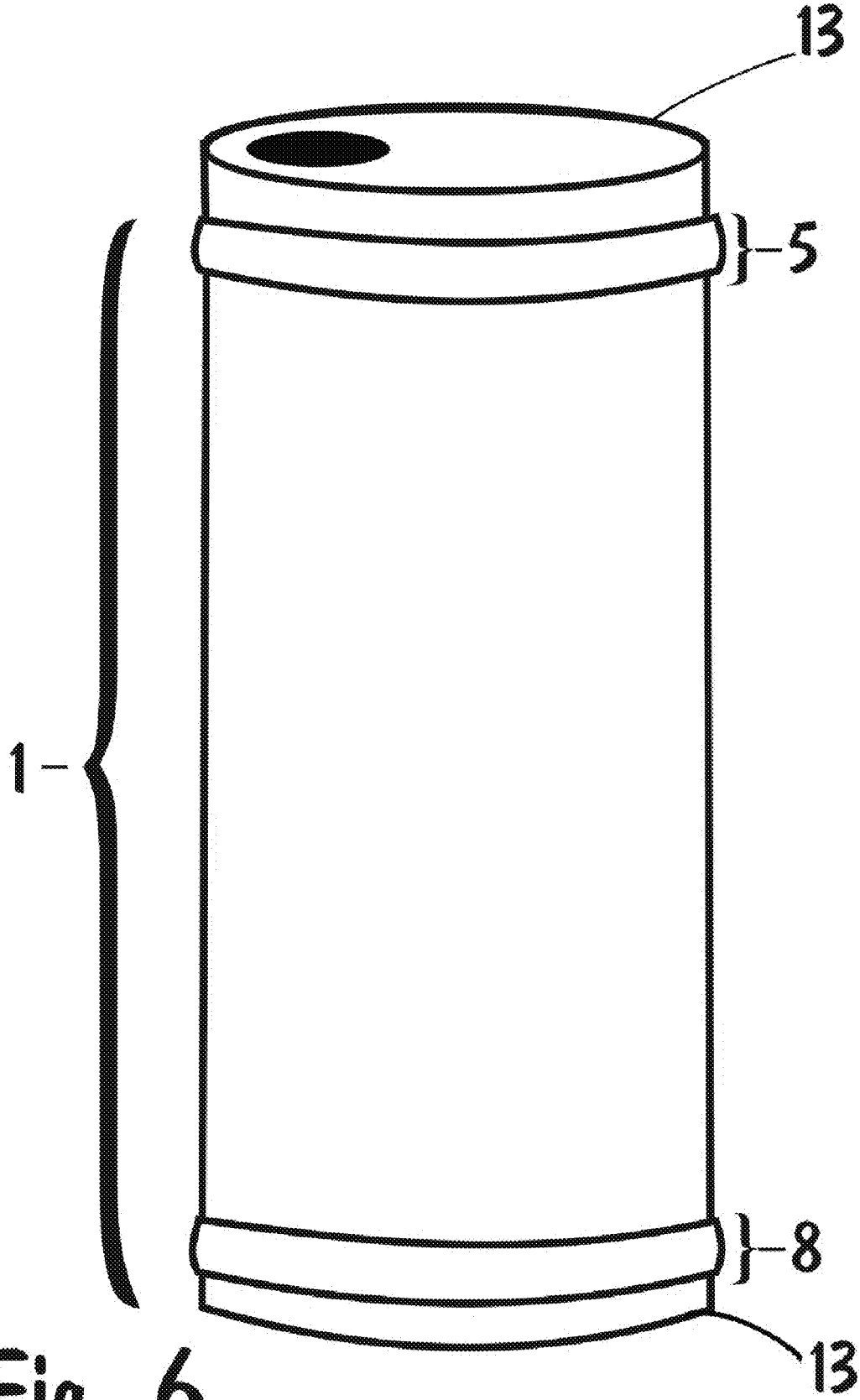
FIG. 6 is a perspective view of the jacket of the invention over a 24 oz like can.

FIG. 6 depicts the article of the invention 1 in use over a 24 oz can 13. As can be seen in this embodiment the jacket 1 is stretched over the can and held in place by the stretch of the fabric without wrinkles or other use problems. The can sticks out the top welt area 5 opening and bottom welt area 8 opening by a small amount allowing the bottle to sit on a table or the like using an uncovered bottle surface and exposing the bottle to for drinking purposes. However, the knitted jacket can be slid down over the bottom of the bottle to be used as a coaster like product.

Figure 7:
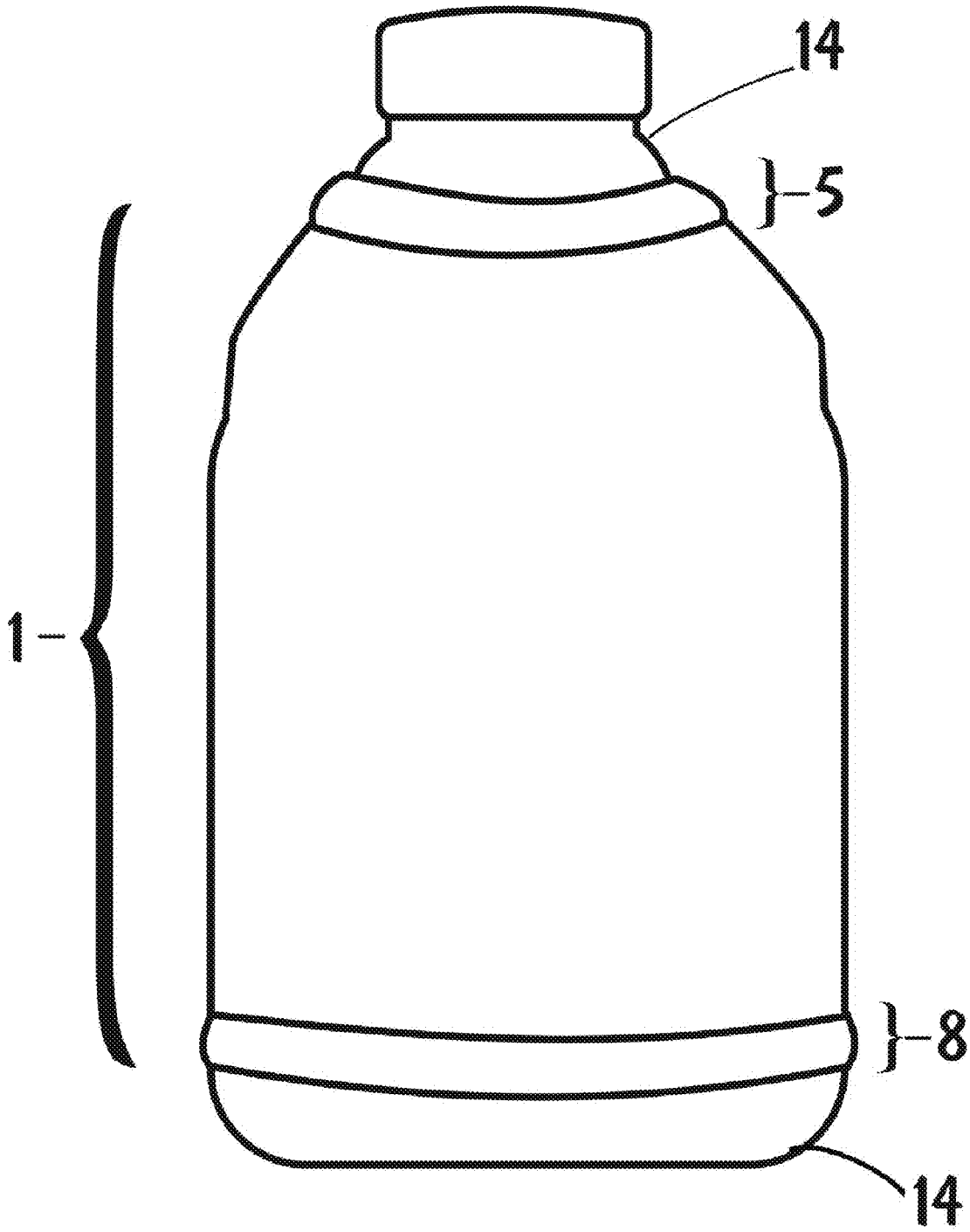
FIG. 7 is a perspective view of the jacket of the invention over a sports drink like bottle.

FIG. 7 depicts the article of the invention 1 in use over a sports drink like bottle 14. As can be seen in this embodiment the jacket 1 is stretched over the bottle and held in place by the stretch of the fabric without wrinkles or other use problems. The bottle sticks out the top welt area 5 opening and bottom welt area 8 opening by a small amount allowing the bottle to sit on a table or the like using an uncovered bottle surface and exposing the bottle to for drinking purposes. However, the knitted jacket can be slid down over the bottom of the bottle to be used as a coaster like product.

EXAMPLE

A knit beverage bottle jacket for a beverage bottle is knit with Courses going length wise and Needles going width wise of a shape generally shown in the Figures. Using a 4 inch cylinder, 108 needle standard sock knitting machine it is made 108 Needles×160 Courses as a final product.

The physical final jacket Size is: Length=6½ inches, Neck=2½ inches, Body=4 inches, Top Width=2 inches, Bottom Width=3 inches.

Fibers for each section were selected as follows:

Denier elastic=LC3803 (2/40/23) Nylon, Lycra.

120 Denier elastic=(1/40/34) Nylon, Lycra.

260 denier elastic=LC146 Nylon, Generic Spandex

Acrylic=High Bulk Acrylic, however other fabrics as listed above could easily be utilized.

Top welt area fabrication—

Inside: 8 courses of Nylon with 260 Denier generic LC146 Spandex wrapped Nylon.

Outside: 8 courses of high bulk acrylic with 260 Denier generic LC146 Spandex wrapped Nylon and 20 Denier LC3803 (2/40/23) Lyrca wrapped Nylon.

Neck area fabrication—

34 courses of high bulk acrylic with 260 Denier generic LC146 Spandex wrapped Nylon and 20 Denier LC3803 (2/40/23) Lyrca wrapped Nylon.

Body area fabrication—

88 courses of high bulk acrylic with 260 Denier generic LC146 Spandex wrapped Nylon and 120 Denier (1/40/34) Lyrca wrapped Nylon.

Bottom welt area fabrication—

Outside: 7 courses of high bulk acrylic with 260 Denier generic LC146 Spandex wrapped Nylon and 120 Denier (1/40/34) Lyrca wrapped Nylon.

Inside: 14 courses of 20 denier LC3803 (2/40/23) Lyrca wrapped Nylon with 260 Denier generic LC146 Spandex wrapped Nylon.

One skilled in the art will be able to take the information, examples different fibers and manufacture different bottle jackets in accordance with the present invention. The claims should be read as covering a wide variety of embodiments based on the teaching herein.

What is claimed is:

1. A bottle knitted jacket comprising:

a) a top welt area inside area comprising:

i. a polyamide fiber; and ii. an elastomeric covered polyamide fiber having a denier from about 160 to about 320;

wherein the top welt inside area can extend to the inside neck of the jacket;

b) a top welt area outside area comprising:

i. a non-elastomeric fiber;

ii. an elastomer covered polyamide fiber having a denier from about 5 to about 60; and iii. an elastomeric covered polyamide fiber having a denier from about 160 to about 320;

c) bottom welt area inside area;

i. an elastomer covered polyamide fiber having a denier from about 5 to about 60; and ii. an elastomeric covered polyamide fiber having a denier from about 160 to about 320;

wherein the bottom welt inside area can extend to the inside body of the jacket;

d) a bottom welt area outside area comprising:

i. a non-elastomeric fiber;

ii. an elastomer covered polyamide fiber having a denier from about 60 to about 220; and iii. an elastomeric covered polyamide fiber having a denier from about 160 to about 320;

e) a neck area comprising i. a non-elastomeric fiber;

ii. an elastomer covered polyamide fiber having a denier from about 5 to about 60; and iii. an elastomeric covered polyamide fiber having a denier from about 160 to about 320; and f) a body area comprising;

i. a non-elastomeric fiber;

ii. elastomer covered polyamide fiber having a denier from about 60 to about 220; and iii. an elastomeric covered polyamide fiber having a denier from about 160 to about 320.

2. A bottle jacket according to claim 1 wherein the elastomer is spandex.

3. A bottle jacket according to claim 1 wherein the polyamide fiber is a nylon fiber.

4. A bottle jacket according to claim 1 wherein the acrylic fiber is a high bulk acrylic.

5. A bottle jacket according to claim 1 wherein the elastomeric covered polyamide fibers in the top welt area outside area, neck area and bottom welt area inside area are about 20 denier.

6. A bottle jacket according to claim 1 wherein the elastomeric covered polymide fibers in the bottom welt area outside area and body area are about 120 denier.

7. A bottle jacket according to claim 1 wherein the elastomeric covered polyamide fiber has a denier of about 260.

8. A bottle jacket according to claim 1 which further comprises an advertisement or artistic design knit into the fabric at least along the neck or body area.

9. A bottle jacket according to claim 1 wherein the neck area is tapered to fit a tapered neck bottle.

10. A bottle jacket according to claim 1 wherein the neck area is tapered to fit a tapered neck bottle but can fit non-tapered bottles.

11. A bottle jacket according to claim 1 wherein the bottom welt can be positioned on the bottle to form a coaster.

* * * * *